US005289748A

United States Patent [19]

Kuchta et al.

[11] Patent Number: 5,289,748

[45] Date of Patent: Mar. 1, 1994

[54] CUTTER RE-SEALER USING TENSIONED OVERLAY AND RELATED METHOD

[75] Inventors: Richard Kuchta, Tolland; Vladimir Evenzon, Vernon; Larry Billings, Manchester, all of Conn.; Philip W. Cenedella, East Douglas, Mass.

[73] Assignee: Gerber Garment Technologies, Inc., Tolland, Conn.

[21] Appl. No.: 872,508

[22] Filed: Apr. 23, 1992

[51] Int. Cl.[5] ..... B26D 7/02

[52] U.S. Cl. ..... 83/56; 83/941; 83/451; 83/152

[58] Field of Search ..... 83/19, 56, 936–941, 83/451, 385, 152; 242/107

[56] References Cited

U.S. PATENT DOCUMENTS

| | | | |
|---|---|---|---|
| 3,682,750 | 8/1992 | Gerber | 83/941 |
| 4,434,691 | 3/1984 | LeBlond | 83/56 |
| 4,452,113 | 6/1984 | Pearl | 83/941 |
| 5,119,704 | 6/1992 | Wolfson | 83/155 |

FOREIGN PATENT DOCUMENTS

| | | | |
|---|---|---|---|
| 0618942 | 8/1980 | Switzerland | 242/107 |

*Primary Examiner*—Richard K. Seidel
*Assistant Examiner*—Allan M. Schrock
*Attorney, Agent, or Firm*—McCormick, Paulding & Huber

[57] ABSTRACT

An automated cutter bed employs a sealer which is mechanically coupled to a tool carriage and moves with it along a first coordinate direction. A first roller is connected with a second roller disposed at the take-off end of the table by an air impermeable sheet which is tensioned between the two rollers by a resilient member housed within each of the rollers causing a preload to be exerted on the air impermeable sheet material. The first roller moves between ends of the table paying out a length of the air impermeable material. As the carriage moves to the cutter datum, equalization is effected by the preloads given in each of the first and second rollers.

22 Claims, 8 Drawing Sheets

CUTTER RE-SEALER USING TENSIONED OVERLAY AND RELATED METHOD

CROSS REFERENCE TO RELATED APPLICATIONS

This application relates to U.S. co-pending application Ser. No. 07/681,860 entitled COMBINED CUTTING MACHINE AND TAKE-OFF TABLE of Lawrence Wolfson, filed on Apr. 5, 1991, which application being commonly assigned with the assignee of the present invention.

BACKGROUND OF THE INVENTION

This invention relates to an apparatus for cutting a layup of limp sheet material, such as fabric for making clothing or upholstery, and deals more particularly with a cutting machine having a vacuum hold-down system for compressing the layup of limp sheet material and a re-sealing system which lays down an overlay sheet onto the layup of material after cuts are made in it during a cutting operation so as to seal the cuts to effect continuous and even holding of the layup on the support surface during the remainder of the cutting operation. The vacuum holddown is one of the conveyorized type effecting bite-by-bite advancement and holding of a layup whose length is often several times longer than that of the support surface. The cutting operation is conducted on each bite of the layup length such that as one operation is completed on one segment of the layup length, another cutting operation begins on a new segment after the one segment it is advanced off the support surface and the new segment is advanced onto it.

Systems for sealing cuts made in a layup of sheet material during a cutting operation using an overlay sheet are known in automated cutting machines. In U.S. Pat. No. 4,542,673 issued to David Pearl on Sep. 24, 1985 and assigned to Gerber Garment Technology, Inc., it is disclosed therein to provide an apparatus for sealing the cut sheet material by providing an air impermeable sheet wound on a retractable roll carried by the cutting carriage assembly. The free or unwound end of the air impermeable sheet is held to a clamping bar at the discharge end of the cutting table and the sheet material is caused to pay out from the roll as the carriage moves away from the clamping bar during its cutting operation. With this arrangement, the entire mass of the roll of air impermeable sheet material is carried by the carriage along with the cutter head above the support surface. As a result, the carriage must be made from more substantial material than it would otherwise have to be to support both loads, thus increasing its manufacturing cost. Another approach is disclosed in U.S. Pat. No. 4,452,113 entitled METHOD AND APPARATUS FOR SEALING CUT SHEET MATERIAL issued to David Pearl on Jun. 5, 1984, and being commonly assigned to Gerber Garment Technology, Inc. Here an air impermeable overlay, which seals the sheet material when cut, is wound onto a roller which in turn is supported on a separate sealing roller carriage. This separate sealing carriage runs along tracks formed on the table and is mechanically coupled to the cutter head carriage so as to be slaved to its movements as the carriage is advanced during a cutting operation. Providing a separate sealing carriage as therein disclosed likewise has been found to increase the cost of production for a cutter as well as complicating its use. In U.S. Pat. No. 4,434,691 issued to Claude W. LeBlond on Mar. 6, 1984 and entitled METHOD AND APPARATUS FOR SEALING CUT SHEET MATERIAL, it is disclosed to pull a roller over the layup of sheet material using the cutter carriage to effect covering of the cuts made in the layup during a cutting operation. For this, a roll of air impermeable overlay material is rotatably mounted to the cutter carriage and is rolled over the layup with carriage as it is advanced during the cutting operation. The free end of the overlay material is connected to a drive roll which drivingly controllably rotates to take up the overlay with the bite of sheet material being advanced off the table. It is thus necessary to periodically shift the overlay material accumulating on the drive roller back to the overlay roller. Thus, the system employs a drive motor and drive associated with the drive roll to take up the overlay with the advancement of each bite which undesirably adds to the cost of manufacturing for the machine.

Accordingly, it is an object of the present invention to provide a layup re-sealing system wherein the overlay material is wound on a resealer roll that is not carried by a carriage and in which the free end of the overlay need not be secured to a controllably driven drive roller for purposes of maintaining a supply of the overlay material on the resealer roller for use in successive cutting operations.

Yet a further object of the present invention is to provide a sealing system whereby the overlay sheet and the table on which a layup of sheet material is supported effect full sealing engagement along the take-off end of the table.

A further object of the present invention is to provide a system for automatically re-sealing cuts made in a layup of the aforementioned type wherein the overlay sheet material continually is maintained in equilibrium between two rollers after every bite advancement and need not be periodically shifted after it accumulates on one of two rollers.

Other objects and advantages of the present invention will become apparent from the following description and the appended claims.

SUMMARY OF THE INVENTION

A re-sealing system for sealing cuts made in a layup spread over a support surface of an automated cutting machine comprises a frame having a first end and an opposite second end, a support surface mounted on the frame and moveable therealong between the frame first and second ends in one coordinate direction and a carriage supported by the frame above the support surface and moveable relative to the frame in the one coordinate direction. A vacuum means is associated with the moveable support surface for causing air to be drawn through the support surface from a vacuum source to cause a layup of sheet material supported by the support surface to be compressed and held in place against the support surface. A first roller is rotatably mounted to the carriage for movement with the carriage along the one coordinate direction and a second roller is rotatably mounted to the frame and is associated with the frame second end, the second roller extends generally parallel to and in alignment with the first roller. An elongate sheet of air impermeable material having opposite ends wound about the first and second rollers respectively and a portion of the sheet extending between the first and second rollers for sealing cut sheet material on the support surface. The first and second rollers have means for automatically returning an amount of the air impermeable material previously dispensed from one of the first and second rollers to the other of the first and second rollers in response to the movement of the carriage along the one coordinate direction between the first and second ends of the frame.

The invention further resides in a method of operation for the resealer system set forth above wherein a preload is applied to each of the first and second rollers in opposite directions and the preloads in the first and second rollers act on the air impermeable sheet during cutting and advancement operations to automatically rewind a length of the air impermeable material onto the one of the first and second rollers from which it was dispensed to cause an equilibrium state to be maintained between each of the first ands second rollers.

DETAILED DESCRIPTION OF THE PREFERRED EMBODIMENT

Figure 1:
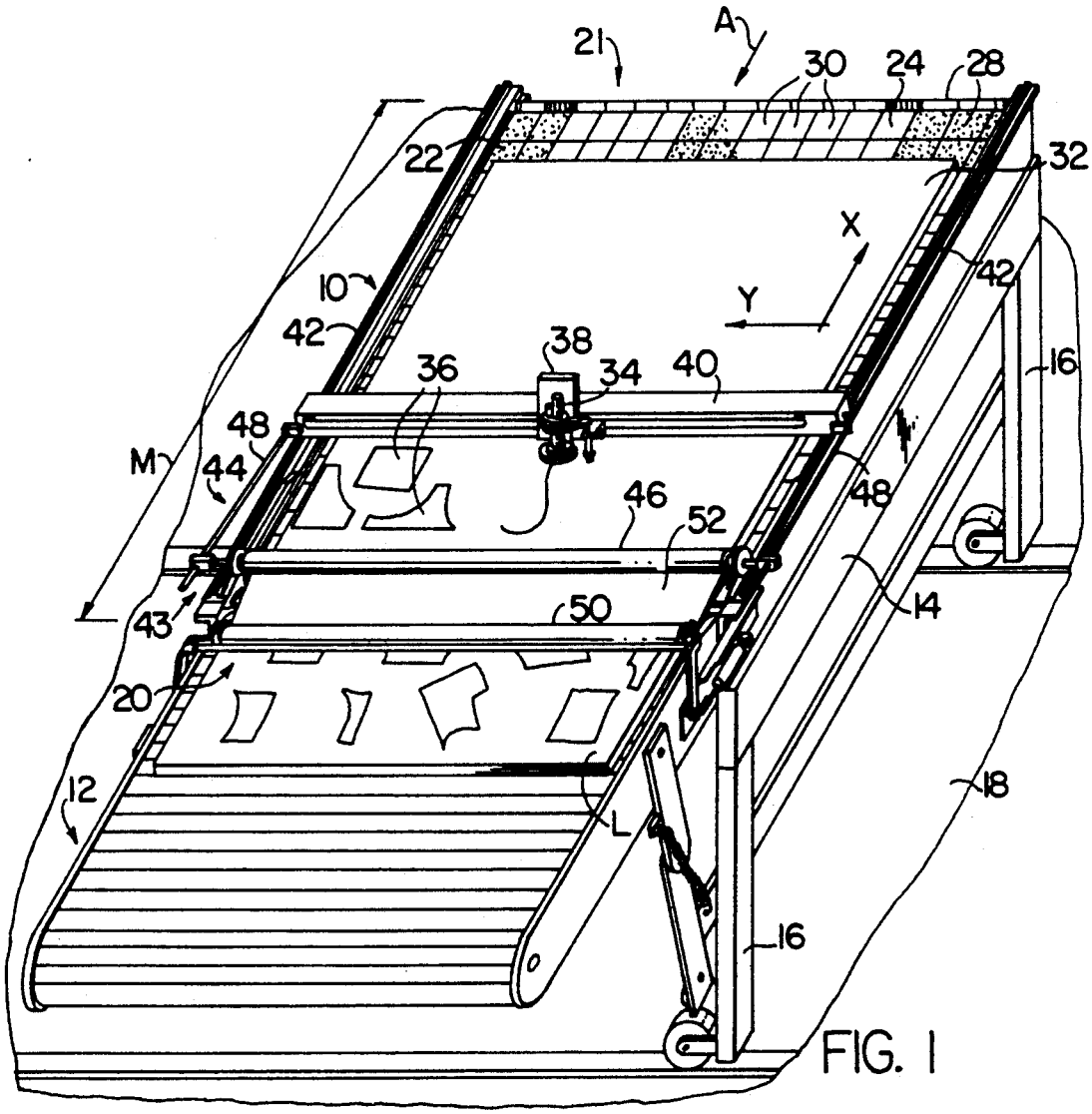
FIG. 1 is a perspective view showing the invention embodied in an automated cutting machine or table.

Turning to the drawings and first to FIG. 1, a machine employing the invention includes an automated cutting table 10 combined with a means for off-loading sheet material L from the table, in the illustrated example this means is being shown as a take-off table 12. The machine 10 includes a frame 14, a means carried by the frame 14 for providing an upwardly facing flat supporting surface 22 located in a horizontal plane P for supporting the sheet material to be cut. In the illustrated case this means is an endless conveyor 24 trained over rotatable end units located on opposite ends of the frame 14, one of which end units is shown schematically at 26 in FIG. 2 in phantom line. The frame has a take-on end 21 on which the sheet material L is introduced and an off-loading end 20 from which the material is advanced off the table 10. As such, the upper run of the conveyor 24 extends between each of these ends and defines the support surface 22 which is coincident with a generally horizontally disposed plane P. The end units include suitable sprockets positively engaging the conveyor member 24 so that the end units and the conveyor member are constrained to move in unison with one another. One of the end units is driven by a drive motor (not shown) drivingly connected with the associated end unit by a positive drive power transmission means, such as a toothed belt or chain cooperating with suitable sprockets fixed to the drive shaft of the motor and to the connected one of the end units. The endless conveyor 24 is supported on the frame 14 above a floor 18 on a plurality of legs 16 depending from the frame maintaining the supporting surface 22 above the floor 18.

The conveyor 24 moves in the indicated direction A parallel to the illustrated X coordinate direction upon normal forward operation. The conveyor member may take many different forms, but as illustrated, it is comprised of a plurality of slats 28, 28 extending in the indicated Y coordinate direction transversely of the frame 14 and linked to one another about hinge axes also extending transversely of the frame to form a continuous chain. Each slat carries a number of bristle blocks 30, 30 which when positioned in the upper run of the conveyor member 24 have upwardly extending bristles terminating in the common plane P forming the supporting surface 22. The bristles form a bed which is penetrable by a cutting knife, while also providing a means for containing vacuum pressure communicating to the supporting surface 22 from a vacuum source (not shown) to aid in holding and compressing the material to be cut.

Figure 2:
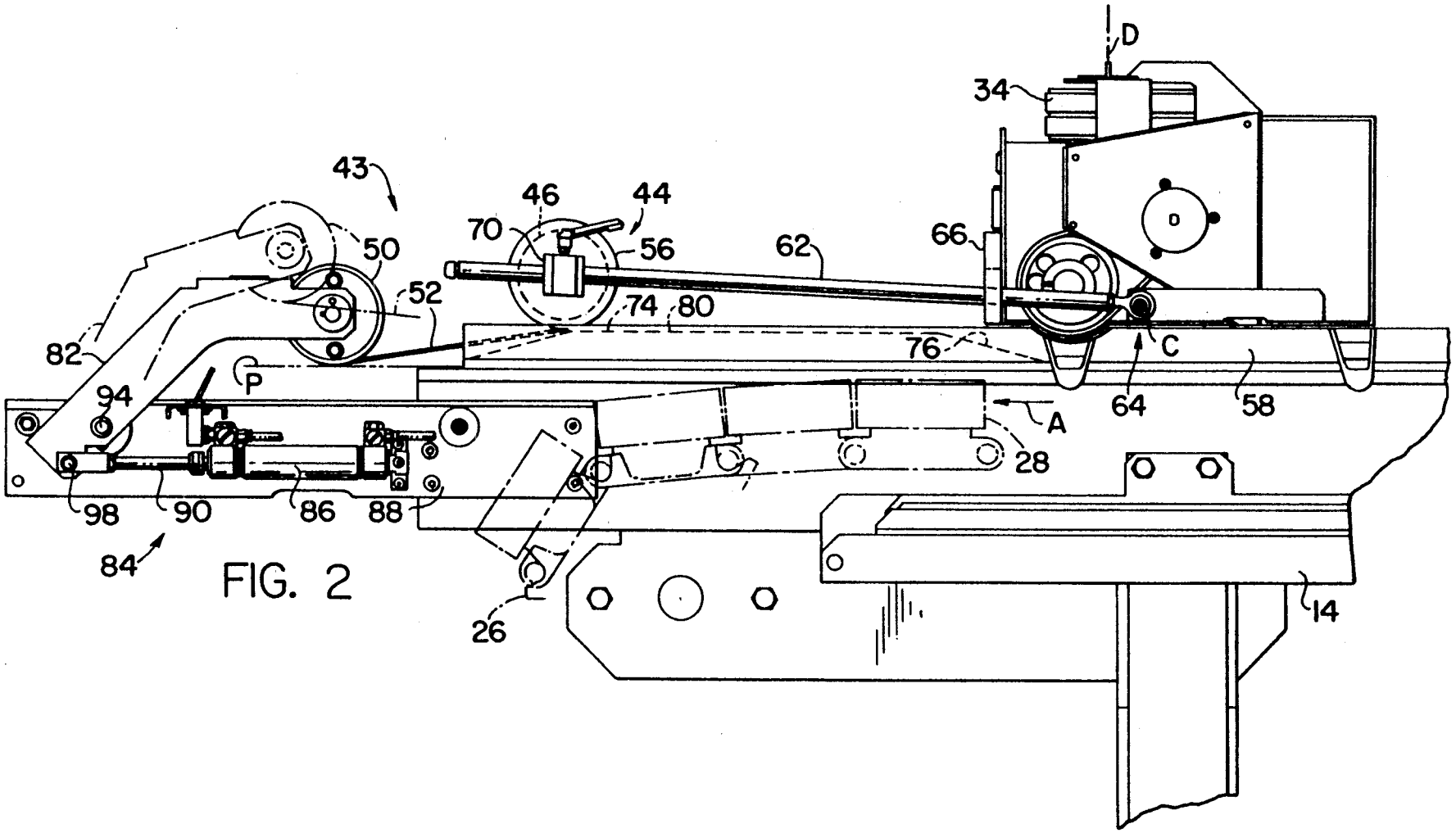
FIG. 2 is a partially fragmentary side elevation view of the machine shown in FIG. 1.
Figure 3:
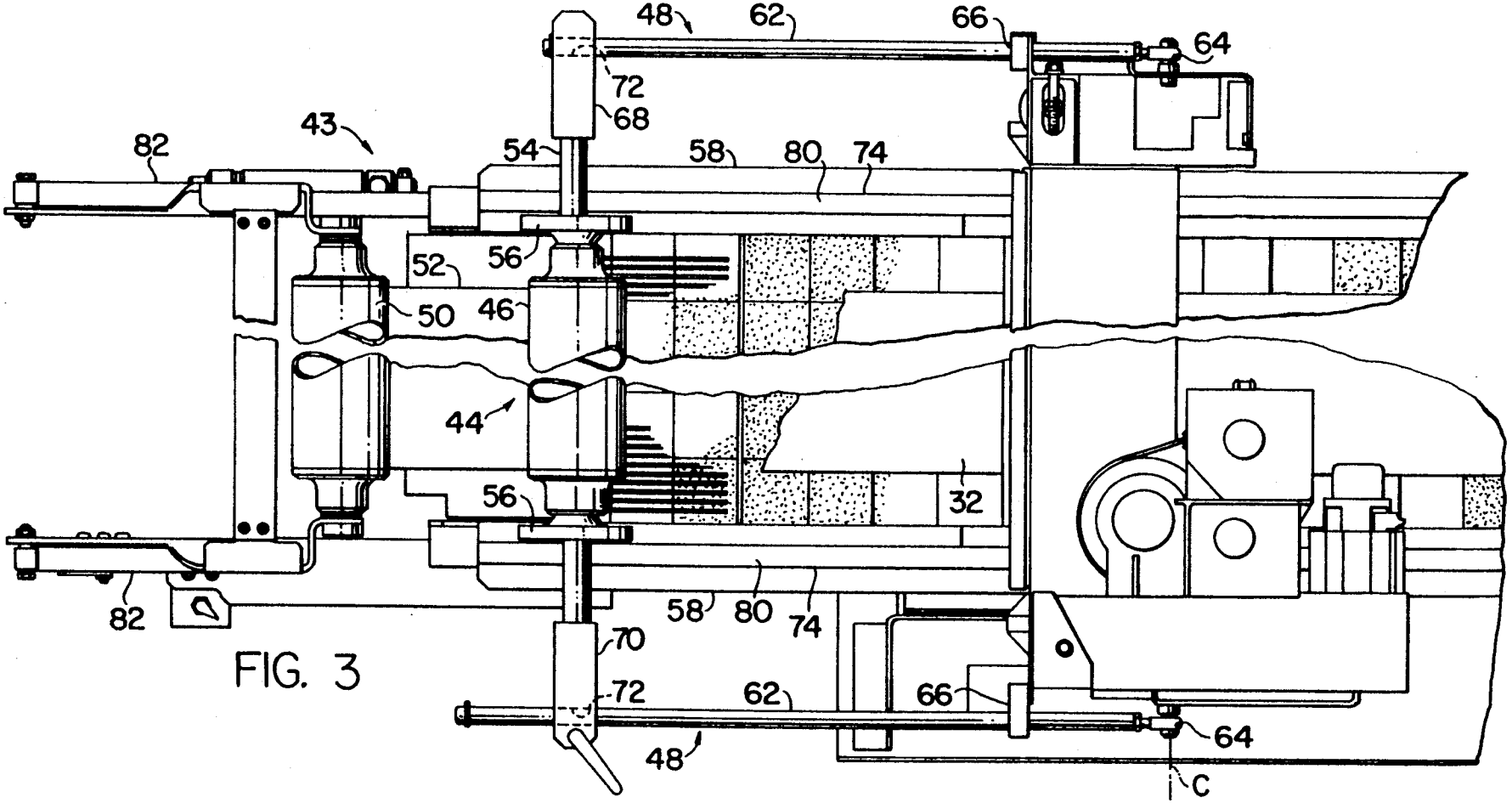
FIG. 3 is a partially fragmentary top plan view of the machine of FIG. 1.

The material L to be cut may consist of a single layer of spread fabric or other sheet material, but in the illustrated case of FIGS. 1 and 2, it is shown to be a layup 32 consisting of a number of fabrics or other sheet material spread on top of one another. As will hereinafter become more readily apparent, the sheet or sheets of fabric or other sheet material spread on top of the supporting surface 22 are caused to be compressed against the surface to condition it for better cutting. To this end, a vacuum system is provided as part of the table 10 and is structured to cooperate with the conveyor 24 to provide vacuum to the upper run of the conveyor during a cutting operation and when it is advancing the sheet material in the indicated advancement direction A. The particulars of one such vacuum system are disclosed in co-pending U.S. application Ser. No. 07/681,862 entitled CONVEYOR FOR SUPPORTING AND ADVANCING SHEET MATERIAL AND CUTTING MACHINE INCLUDING SUCH CONVEYOR, filed in the name of H. Joseph Gerber et al. on Apr. 5, 1991, and which application being commonly assigned with the assignee of the present invention and being hereby incorporated by reference.

For cutting the work material L supported by the supporting surface 22, the cutting machine includes a cutting head 34 moveable in the illustrated X and Y coordinate directions relative to the supporting surface 22 to cut two dimensional shapes, such as the illustrated pattern pieces 36, 36, in the work material. Preferably the cutter head 34 is one having a vertically reciprocating knife which during at least a portion of its stroke has a lower end that is plunged below the supporting surface 22 and into the bed formed by the bristles of the bristle blocks 30. The cutter head is carried by a Y carriage 38 moveable in the Y coordinate direction relative to a X beam or carriage 40. The X beam 40 extends transversely over the supporting surface 22 and is supported at its opposite ends by guide rails 42, 42 fixed to the machine frame 14 and extending longitudinally thereof in the X coordinate direction. Suitable X and Y drive motors (not shown) controlled by an associated controller drive the Y carriage 38 and the X carriage 40 in coordinated movements in the X and Y coordinate directions to follow lines of cut to produce a desired pattern piece.

In accordance with the invention, the cutting machine 10 includes a re-sealing system 43 associated both with the take-off end 20 of the cutting machine and with the X beam or carriage 40. As illustrated in FIG. 1, the system 43 is adapted to be used with a take-off table 12, but a ramp or other device suitable for directing the cut material from the machine 10 may alternatively be used in place of the take-off. For sealing the cuts 36 made in the sheet material L, a carriage follower means 44 is provided and tracks along the X coordinate direction with the movement of the X carriage 40. The means 44 includes a follower roller 46 adapted to roll over the sheet material L and is connected to the X-carriage for movement with it by a coupling means. The coupling means includes a link means 48 which mechanically connects the follower roller with the X-carriage allowing the roller to be pulled as the carriage performs a cutting operation moving from the take-off end 20 to the take-up end 21 and further includes means for slaving the movement of the X-carriage with that of the conveyor 24 during advancement of a bite of sheet material off the table 10. The system 43 further includes a return roller 50 associated with the take-off end 20 of the table 10 and an overlay sheet 52 having opposite ends respectively wound about each of the follower and the return rollers in a manner that will hereinafter become apparent.

Figure 6A:
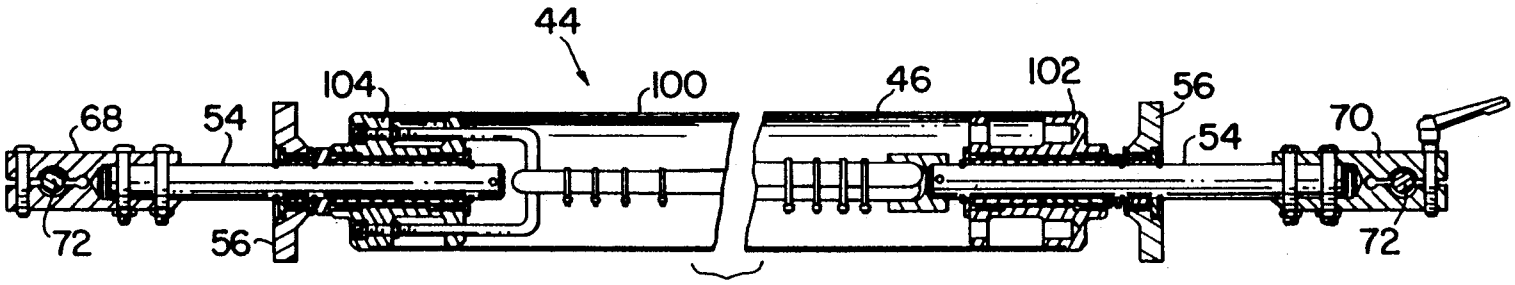
FIG. 6*a* is a partially fragmentary vertical sectional view of the follower roller pulled by the carriage of the cutter shown in FIG. 1.

As shown in FIG. 6*a*, the follower roller 46 is rotatably mounted on a central axle 54 oriented parallel to the Y coordinate direction. The axle 54 is of two piece construction with each piece being associated with an end of the roller 46. Wheels 56, 56 are carried by the axle 54 on each axle piece respectively and are journalled thereon for rotation in either angular direction. The wheels 56, 56 roll along tracks 58, 58 disposed along either side edge of the table 10 extending in the X coordinate direction. The tracks 58, 58 have highly smooth finished surfaces on which the similarly finished circumferential surfaces of the wheels travel to offer negligible resistance to roll. Each wheel 56, 56 is sized diametrically identically with the other, but has an outer diameter of about one quarter inch greater than that of the follower roller 46.

The link means 48 mechanically couple the free ends of the central axle 54 to the X-carriage 40 through the intermediary of two bars 62, 62 each having a first end associated with the X-carriage 40 and a second end associated with the central axle 54. At the first end, each of the bars 62 is connected to the carriage through the intermediary of a ball and socket joint 64, 64. The bars 62 are constrained within slotted holders 66, 66 mounted to the X-carriage 40 to confine the movement of the bars 62, 62 to a single vertical plane parallel to the indicated X coordinate direction. It is noted that the slots formed in each of the holders 66, 66 are sufficiently long to allow the bars to pivot through an angle of about 10 degrees relative to the central point C at the ball and socket joint 64. The opposite ends of the central axis 54 are fixed to clamps 68 and 70 each having a through opening 72 for clamping therein respective ones of each of the bars 62, 62.

As best shown in FIG. 2, the tracks 58, 58 include ramps 74, 74 each having a length of about twelve inches and are defined by a leading incline face 76 disposed at an angle of approximately 10 degrees relative to the horizontally disposed plane P and a raised stretch of track 80 which extends generally parallel to the plane P. The wheels 56, 56 associated with the follower roller 46 are made to travel up the incline face 76 and onto the flat stretch of track 80 when the X-carriage 40 is moved to the cutting datum D to effect breaking of the seal between the overlay sheet 52 and the surface 22. For this purpose, the raised stretches of track 80, 80 stand about 1" above the plane P and provide the necessary clearance for moving the roller 46 upwards to break the seal between the overlay 52 and the supporting surface 22.

Figure 4:
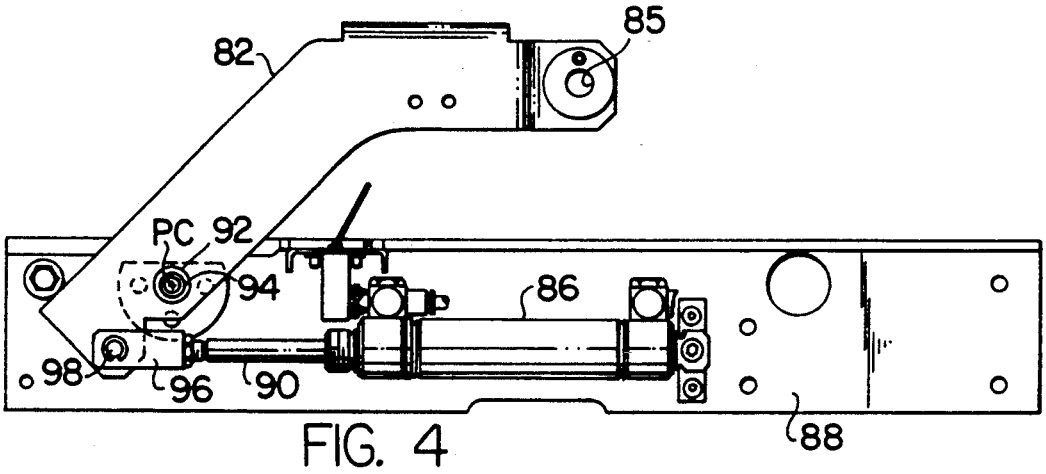
FIG. 4 is a side view of a mounting bracket assembly for the actuator arm holding the take-up roll.
Figure 5:
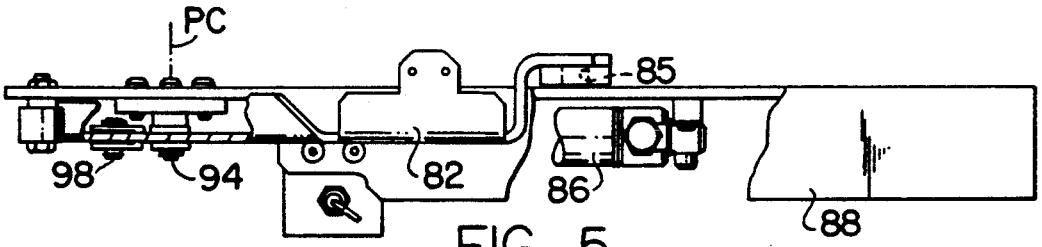
FIG. 5 is a partially fragmentary top elevation view of the bracket shown in FIG. 4.
Figure 6B:
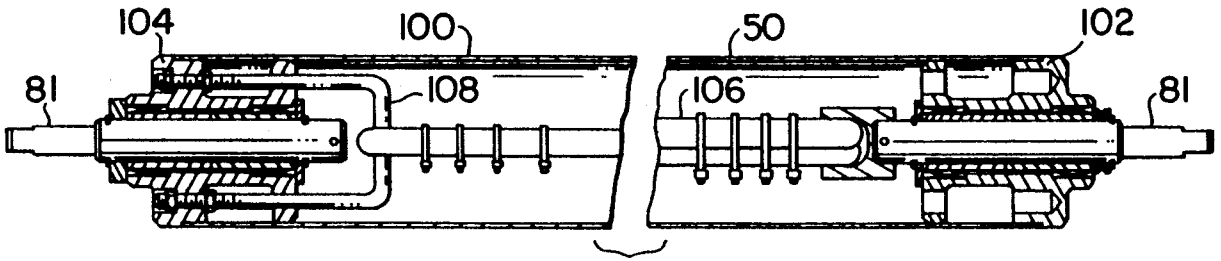
FIG. 6*b* is a partially fragmentary vertical sectional view of the take-up roller which is mounted to the frame of the machine.

The return roller 50 shown in FIG. 6*b* and its associated mounting structure shown in FIGS. 4 and 5, cooperate to bridge the width of the supporting surface 22. The roller 50 for this purpose is supported at its opposite ends by arms 82, 82 pivotally connected to the frame 14 by bracket assemblies 84, 84. A central axle 81 of two-piece construction is nonrotatably received within openings 85, 85 in each of the arms 82, 82 and provides a means about which the roller 50 freely rotates. Each of the bracket assemblies 84, 84 includes a support plate 88 fixed at one end to the frame 14, a pneumatic actuator 86 secured to the plate 88 and having a sliding rod 90 connected to a juxtaposed portion of the arm 82 associated with it. The arms 82, 82 include a journalling means 92 rotatably cooperating with a transversely extending pin 94 fixed to the bracket 88 to permit pivotal movement. Each sliding rod 90 is connected to an associated one of the arms 82, 82 at a point thereon remote from the pivot connection PC so as to create a moment arm thereabout. Associated with each sliding rod 90 is a bifurcated connector 96 secured to the free end of the rod and connected to the arm by a pin 98.

As shown in FIG. 2, the arms 82, 82 controllably locate the lower circumference of the return roller 50 substantially coincidentally with the plane P which includes the supporting surface 22 when the roller 50 is disposed at its lowered position and locate the roller 50 in a raised second position (phantom line) above and away from the plane P. This movement is accomplished by controllably energizing the actuators 86, 86 to drive the rods 90, 90 between extended and retracted positions corresponding respectively to the the roll 50 being located at its lower or uppermost locations. This orientation serves to effect better sealing of the overlay 52 with the sheet material L starting at the take-off end 20 of the table 10. Further, by placing the lowermost circumference of the return roller 50 substantially below the flat raised stretches 80, 80 of the tracks 58, 58, breaking of the vacuum seal between the overlay 52 and the sheet material L is effected when the X-carriage 40 approaches the datum D in turn driving the wheels 56, 56 up the incline faces 76, 76 of the ramps 74, 74.

It should be seen that the overlay material 52 wound on each of the follower and return rollers 46 and 50 is maintained in tension. To this end, the rollers 46 and 50 are formed from generally cylindrical housings 100, 100 each having plug members 102, 102 and 104, 104 disposed at opposite ends thereof. Each of the plug members 102 and 104 has an internal bearing system allowing the rollers 46 and 50 to be freely rotatably mounted about respective pieces of the shafts 54 and 81 associated with them. The plugs 104, 104 disposed in each of the rollers 46 and 50 include a yoke means 108 for connecting an elongate elastic member 106 between it and the opposed shaft part. That is, since one end of the elastic member 106 is connected to the yoke means 108 which is freely rotatably mounted about one piece of the shafts 54 and 81 while its other opposite end is connected to the nonrotatably mounted other shaft piece, the effect of rotating the roller relative to the frame 14 causes a counteracting rotational force to be created in the elastic member 106.

Figure 7:
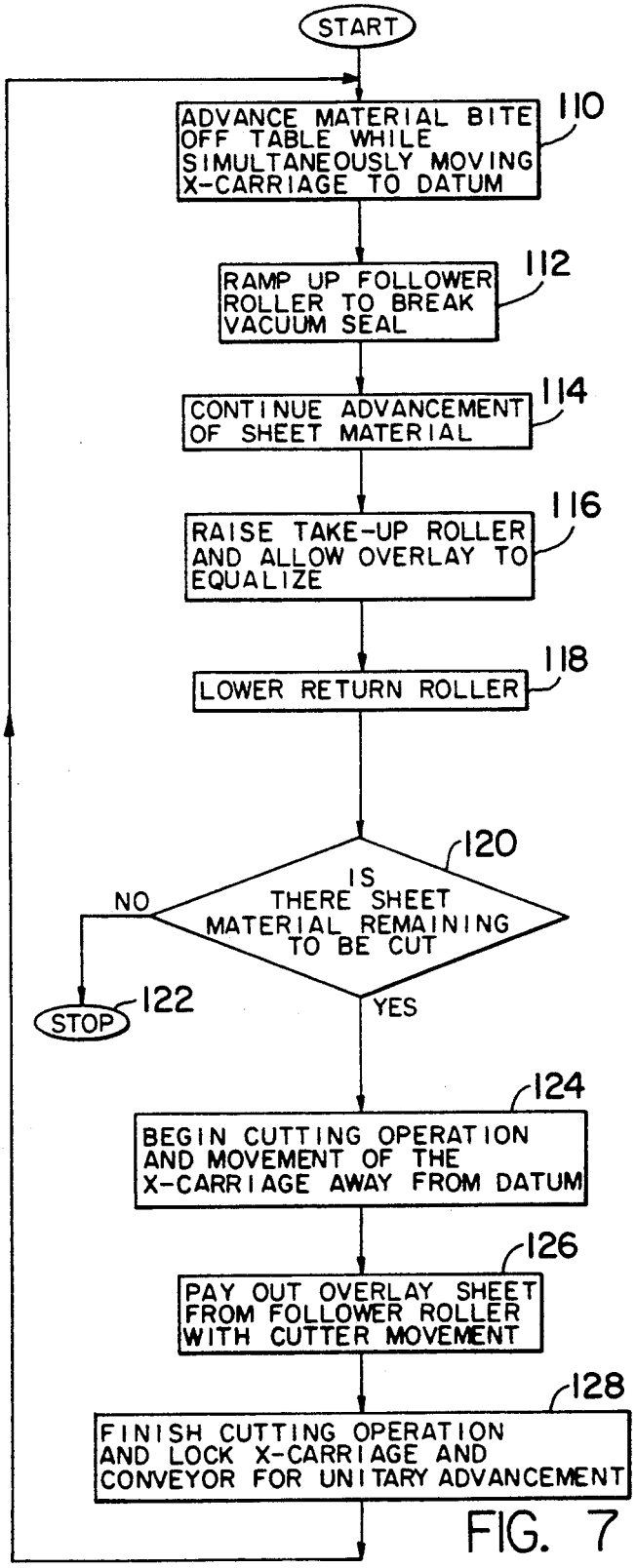
FIG. 7 is a flow chart of the operation of the cutter and re-sealing system of the present invention.

Turning now to FIG. 7 and to the operation of the sealing system 43, it should be seen that after a cutting operation is performed on a length of material, the conveyor member 24 is advanced still under vacuum in the A conveying direction to move the material L off the take-off end 20 of the table (step 110). The X-carriage movement is slaved with that of the conveyor member 24 so that if the bite being advanced is in the middle of a cut line, then exact registration along the involved cut line can be achieved without regard for inadvertent relative movement. This feature is disclosed in co-pending U.S. patent application 07/681,859 entitled APPARATUS AND METHOD FOR AUTOMATICALLY CUTTING A LENGTH OF SHEET MATERIAL SEGMENT-BY-SEGMENT, filed in the name of Richard Kuchta on Apr. 5, 1991, and being commonly assigned with the assignee of the present invention.

As the X-carriage approaches the cutting datum D, the wheels 56, 56 of the follower roller are driven up the ramp 74 and are caused to be supported on raised stretches 80, 80 of the tracks 58, 58. In doing so, the seal between the overlay sheet 52 and the material L is initially broken in the vicinity of the follower roller 46 (step 112). Advancement of the conveyor 24 continues under vacuum until the involved bite length of material is moved off the table (step 114). Thereafter, the return roller 50 is raised as shown in phantom line in FIG. 2 thereby allow equalization of the overlay sheet length to occur (step 116) in a manner that will be discussed in further detail with reference to FIGS. 8*a*–8*d*. The return roller 50 is thereafter moved to its lowermost position shown in solid in FIG. 2 (step 118).

A check is next made to determine whether there is additional sheet material to be cut (step 120), and if so, the cutter 34 will pick up exactly where it left off in the same material or begin cutting a new layup length. In circumstance where the transition between different layups occurs within the same bite, the cutter 34 is capable of starting a new cutting operation on the next layup while both layups are held on the supporting surface in their original end-to-end relationship. Thus, it is a feature of the invention that the follower roller 46 be provided with a desired diametric ratio relative to the maximum thickness of the layup capable of being cut such that if the next layup advanced is of a substantially different thickness, the roller 46 is capable of rolling over the step or shoulder created by the thickness differential without substantially impacting on the X carriage. It has been found empirically that this ratio is equal to about three to one for a maximum layup thickness of 1". If there is no sheet material remaining to be cut, then the cutting operation stops (step 122).

Assuming that there is material L remaining to be cut, then the cutting operation again begins at the datum D and the movement of the X carriage is away from this datum and towards the take-on end 21 of the table (step 124). In so doing, the overlay sheet 52 pays out over the cut layup L as the follower roller 46 is moved by the X-carriage (step 126). The overlay sheet is drawn down onto the material L by vacuum pressure acting through the cuts 36 formed in it. Once the cutting operation is finished, the X-carriage being located at the take-up end 21 of the table, is then locked either electronically or mechanically to the conveyor member 24 (step 128) for advancement in a manner disclosed with reference to step 110 above. The operation then proceeds with the advancement step 110.

Figure 8A:
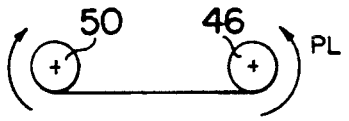
FIGS. 8*a*–8*d* illustrate the self equalization feature provided between each of the follower and take-up rolls.

FIGS. 8*a* through 8*d* illustrate the cooperation between the follower roller 46 and the return roller 50. Initially, as shown in FIG. 8*a*, the rollers are in an equilibrium condition as previously discussed with reference to step 116 wherein preloads created in and exerted by the resilient members 106, 106" cause the overlay 52 to be tensioned therebetween. The preloads PL, PL are equal and opposite and maintain tension on the overlay sheet.

Figure 8B:
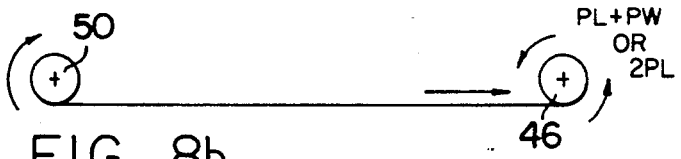

In the second stage of FIG. 8*b*, the follower roller 46 is rolled over the material L by the X-carriage during a cutting operation and a length of the overlay 52 is paid out from the roller 46 in the manner discussed with reference to step 126. Here, the preload PL in the return roller 50 is maintained because the vacuum hold down acts on the overlay sheet 52 to hold it in place on the sheet material L as the overlay sheet 52 pays out from the roller 46. The follower roller 46 however, experiences a counterrotational load equal to the preload PL plus a winding load PW caused by having been rolled over the material L by the movement of the X-carriage. When the X-carriage reaches the end of its cutting operation, it will have paid out a length of the overlay sheet 52 equal to spread length M. Thus, the total load realized by the follower roller 46 at this point is equal to: PL+PW, or 2PL where, the payout length of the overlay sheet 52 equals M.

Figure 8C:
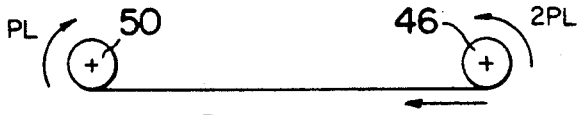
Figure 8D:
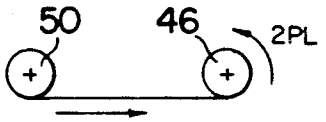

In the third stage, illustrated in FIG. 8*c*, the follower roller 46 is held stationary with the layup L as the conveyor moves to advance the layup 52 off the table, as described above with reference to step 110. Here the preload PL on the return roller 50 winds the length M of the overlay sheet 52 onto the return roll 50 effectively bringing the preload in that roller to zero. In the fourth stage of operation, as shown in FIG. 8*d*, the follower roller 46 is driven onto the raised stretches 80, 80 of the ramps 74, 74 as described above with reference to step 112, to break the seal with the layup L. This allows the overlay sheet 52 to be rewound through a length M back onto the follower roller 46 from the return roller 50 due to the follower roller having the stronger counter rotating force until the initial offsetting preloads PL, PL are realized by each of the rollers 46 and 50. In this way, the section of the overlay sheet between each of the rollers 46 and 50 is automatically returned to the initial condition shown in FIG. 8*a* without need of a drive motor to rotate the return roller 50.

By the foregoing, a re-sealing system has been described by way of illustration rather than limitation.

We claim:

1. A re-sealing system for sealing cuts made in a layup comprised of a ply or stack of plies of sheet material spread over a support surface of an automated cutting machine, said system comprising:

a frame having a first end and an opposite second end;

a support surface mounted on said frame and moveable therealong between said frame first and said frame second ends in one coordinate direction;

a carriage supported by said frame above said support surface and moveable relative to said frame in said one coordinate direction;

vacuum means associated with said moveable support surface for causing air to be drawn through said support surface from a vacuum source to cause sheet material supported by said support surface to be compressed and held in place against the support surface;

a first roller rotatably mounted to said carriage for movement with the carriage along said one coordinate direction;

a second roller rotatably mounted to said frame and associated with said frame second end; said second roller extending generally parallel to and in alignment with said first roller;

an elongate sheet of air impermeable material having opposite ends wound about said first and second rollers respectively with a portion of the air impermeable sheet material extending between said first and second rollers for sealing cut sheet material on the support surface; and a first resilient means comprising a first member fastened at one end to said first roller and fastened at its opposite end to said carriage for causing said first roller to be rotatably mounted to said carriage against the bias of said first resilient means and a second resilient means comprising a second member fastened at one end to said second roller and fastened at its opposite end to said frame for causing said second roller to be rotatably mounted to said frame against the bias of said second resilient means, and each of said first and second resilient means effecting automatic returning of an amount of said air impermeable material previously dispensed from one of said first and second rollers to the other of said first and second rollers in response to the movement of the carriage along said one coordinate direction between said first and second ends of said frame.

2. A system as defined in claim 1 further characterized in that said first and second members are internally housed within each of said first and second roller respectively; and wherein said first and second members apply equal and opposite torsional preloads to each of said first and second rollers respectively.

3. A system as defined in claim 2 further characterized in that said first roller has a diameter related by ratio to the maximum thickness of the layup to be cut equalling about 3:1 to allow it to roll over a layup of sheet material placed down onto the supporting surface.

4. A system as defined in claim 2 further characterized in that said first roller includes a cylindrical housing rotatably mounted on shaft means extending transversely to said one coordinate direction;

said first roller cylindrical housing and said associated shaft means being rotatably connected through the intermediary of plug means associated with each end of first roller cylindrical housing;

said shaft means including two wheels each rotatably mounted to it on opposite ends of said first roller and cooperating each with two parallel spaced apart tracks disposed on opposite sides of said supporting surface and extending in said one coordinate direction; and wherein said wheels each has an outer diameter which is slightly larger than the outer diameter of said first roller cylinder.

5. A system as defined in claim 4 further characterized in that each of said tracks includes a ramp portion disposed generally adjacent said second end of said frame;

each of said ramp portions has an incline face, and a raised flat portion continuous therewith;

said first roller includes a link means connecting said first roller to said carriage such that it can pulled from said table second end to said table first end during a cutting operation; and wherein said ramp portion on each of said tracks engaging with said wheels on said first said roller means as said first roller means is moved from said first end of said frame towards said second end.

6. A system as defined in claim 5 further characterized in that said carriage and said moveable support surface being capable of locking in registration with one another and advancing from said first end of said frame to a datum located adjacent said second frame end to advance sheet material off said support surface while simultaneously driving said wheels of said first roller onto said ramp portions of each of said tracks to lift said air impermeable sheet material off said support surface.

7. A system as defined in claim 6 further characterized in that said second roller includes a means for controllably mounting said second roller between a first position wherein the lower extent of said second roller is positioned approximately coincidentally with a plane which includes said support surface and a second raised position wherein the lower end of said second roller is located substantially above said plane;

said means controllably mounting said second roller includes two pivotal arms each associated with opposite ends of said second roller and pivotally connected to said frame;

said second roller being comprised of a hollow cylinder having a plug means associated each of its ends, said plug means including journalling means for receiving shaft means therein; and wherein said shaft means is nonrotatably connected to each of said pivot arms.

8. A system as defined in claim 1 further characterized in that said resilient means associated with each of said first and second rollers for automatically returning an amount of sheet material to the roller from which it was unwound includes an elongate elastic member extending axially of the roller internally thereof.

9. A system as defined in claim 7 further characterized in that each of said pivot arms supporting said second roller is pivotally connected to a bracket assembly mounted to said second end of said frame; and wherein each of said arms is associated with an actuator connected to it at a point remote from the pivot point of said arm, said actuator being secured to said frame so as to cause said second roller to be moved between said first and second positions upon the appropriate energization of said actuator.

10. A system as defined in claim 1 further characterized in that said carriage is a tool carriage supporting a tool for movement in another coordinate direction disposed orthogonally to said one coordinate direction; and wherein said tool is a cutter head having a reciprocating blade which is driven below said support surface for at least part of its stroke.

11. A system as defined in claim 10 further characterized in that said support surface is a conveyor member having an upper run which defines said support surface; and wherein said conveyor member is comprised of transversely extending slats taken relative to said one coordinate direction, each of said flats receiving a bristle block the upper ends of which defining said support surface.

12. An automatically controlled cutting machine for cutting layups of limp sheet material comprising:

a cutting table in the form of a conveyor table having a conveyor belt defining a support surface on which a multiply layup of limp sheet material is spread for cutting and for movement along the table;

a tool carriage moveable back and forth over the cutting table in a first coordinate direction and having a tool moveable in a second coordinate direction along said carriage to perform cutting operations on the material;

vacuum generating means connectable with the layup of sheet material on the support surface for generating a vacuum within the layup and compressing the sheet material on the support surface;

said tool carriage having a first roller mounting means and said cutting table having a second roller mounting means;

a first roller associated with said tool carriage and connected with it through said first roller mounting means for rolling over a ply or plies of sheet material supported on said table;

a second roller mounted to said table through said second roller mounting means and linked to said first roller by a sheet of air impermeable material wound at each of its ends about the first and second rollers respectively; and wherein each of said first and second rollers includes resilient means interposed between said first roller and said first roller mounting means and between said second roller and said second roller mounting means for automatically returning a length of said air impermeable sheet material under the effect of said resilient means to the one of said first and second roller means from which it was dispensed in response to movement of said carriage along said one coordinate axis.

13. A method for sealing cuts made in a layout of sheet material in an automatic cutting machine comprising the steps of:

providing a moveable support surface having a vacuum hold down conveyor type advancement system capable of moving sheet material in a first coordinate direction;

providing a tool carriage moveable along said first coordinate direction between a first end of said frame and the second end of said frame;

providing a first roller means associated with said tool carriage and coupling it for movement with said tool carriage for movement between said first and second ends of said frame;

providing a second roller means disposed at said frame second end and rotatably mounting it to said frame;

providing a first resilient means comprising a first member fastened at one end to said first roller means and fastened at its opposite end to said tool carriage for causing said first roller means to be rotatably mounted to said tool carriage against the bias of said first resilient means and providing a second resilient means comprising a second member fastened at one end to said second roller means and fastened at its opposite end to said frame for causing said second roller means to be rotatably mounted to said frame against the bias of said second resilient means;

providing an air impermeable sheet and winding the opposite ends thereof about each of said first and second roller means to allow the portion of said air impermeable sheet extending therebetween to spread over the sheet material supported on the support surface when said carriage is moved from said second end of said frame to said first end; and applying a preload to each of said first and second roller means in opposite directions using said first and second resilient members respectively associated with each of said first and second roller means and maintaining the sum of said preloads in at least one of said first and second roller means during cutting and advancement operations to automatically rewind a length of said air impermeable material onto the one of said first and second roller means from which it was dispensed to effect an equilibrium state between each of the first and second rollers.

14. A method as defined in claim 13 further characterized by the steps of maintaining the initial preload in said second roller means and unwinding said first roller means against the torsional preload therein to dispense a length of said air impermeable material onto said supporting surface so as to add additional torsion load to said first roller means;

holding said first roller means in a non-rotating state once said carriage has travelled to said first end of said frame after completing a cutting operation and advancing both the support surface, the layup on it and the carriage to a carriage datum in unison; and allowing said preload in said second roller means to take up the air impermeable sheet material as the carriage, support surface, and layup are advanced toward said datum.

15. A method a defined in claim 14 further characterized by the steps of driving said first roller means upwardly away from the layup as said carriage approaches said datum to break the vacuum between said air impermeable overlay sheet and said vacuum table; and allowing said first roller means to exhibit a rewind force on the second roller means to cause the length of overlay material advanced off said frame second end to be wound back on the first roller means.

16. A method as defined in claim 15 further characterized in that said rewind torsional force exhibited by said first roller means on said second roller means is equal to approximately twice the initial preload created in each of said first and second rollers; and wherein said preload has at least given a torsional strength sufficient to rewind a length of the air impermeable material equalling approximately the length of the support surface taken along said one coordinate direction.

17. A method as defined in claim 16 further characterized in that said second roller means includes a pair of pivotal arms disposed on said frame and moveable between a first position located generally coincident with the support surface and a second position located above and away from said support surface; and moving said second roller means to said first position when a cutting operation is taking place so as to draw the air impermeable sheet material down onto said layup to effect more positive sealing of said material.

18. A method as defined in claim 17 further characterized by moving said second roll means to said second position when said first roll means is driven upwardly above said layup as said carriage is moved to said carriage datum to cause said air impermeable material to be transferred from said second roller to said first roller.

19. A method as defined in claim 18 further characterized by providing a ramp means disposed at the second end of said frame and causing said first roller to be raised above said layup by engaging with said ramp means.

20. A re-sealing system for sealing cuts made in a layup comprised of a ply or stack of plies of sheet material spread over a support surface of an automated cutting machine, said system comprising:

a frame having a first end and an opposite second end;

a support surface mounted on said frame and moveable therealong between said frame first and said frame second ends in one coordinate direction;

a carriage supported by said frame above said support surface and moveable relative to said frame in said one coordinate direction;

vacuum means associated with said moveable support surface for causing air to be drawn through said support surface from a vacuum source to cause sheet material supported by said support surface to be compressed and held in place against the support surface;

a first roller rotatably mounted to said carriage for movement with the carriage along said one coordinate direction;

a second roller rotatably mounted to said frame and associated with said frame second end, said second roller extending generally parallel to and in alignment with said first roller;

an elongate sheet of air impermeable material having opposite ends wound about said first and second rollers respectively with a portion of the air impermeable sheet material extending between said first and second rollers for sealing cut sheet material on the support surface;

means associated with each of said first and second rollers for automatically returning an amount of said air impermeable material previously dispensed from one of said first and second rollers to the other of said first and second rollers in response to the movement of the carriage along said one coordinate directions between said first and second ends of said frame;

said means for automatically returning an amount of said air impermeable material includes a resilient member internally housed within each of said first and second rollers;

said resilient members apply equal and opposite torsional preloads to each of said first and second rollers respectively;

said first roller has a diameter related by ratio to the maximum thickness of the layup to be cut equalling about 3:1 to allow it to roll over a layup of sheet material placed down onto the supporting surface;

said first roller includes a cylindrical housing rotatably mounted on shaft means extending transversely to said one coordinate direction;

said first roller cylindrical housing and said associated shaft means being rotatably connected through the intermediary of plug means associated with each end of first roller cylindrical housing;

said shaft means including two wheels each rotatably mounted to it on opposite ends of said first roller and cooperating each with two parallel spaced apart tracks disposed on opposite sides of said supporting surface and extending in said one coordinate direction;

said wheels each has an outer diameter which is slightly larger than the outer diameter of said first roller cylinder;

each of said tracks includes a ramp portion disposed generally adjacent said second end of said frame;

each of said ramp portions has an incline face, and a raised flat portion continues therewith;

said first roller includes a link means connecting said first roller to said carriage such that it can pulled from said table second end to said table first end during a cutting operation; and wherein said ramp portion on each of said tracks engaging with said wheels on said first said roller means as said first roller means is moved from said first end of said frame towards said second end.

21. A re-sealing system for sealing cuts made in a layup comprised of a ply or stack of plies of sheet material spread over a support surface of an automated cutting machine, said system comprising:

a frame having a first end and an opposite second end;

a support surface mounted on said frame and moveable therealong between said frame first and said frame second ends in one coordinate direction;

a carriage supported by said frame above said support surface and moveable relative to said frame in said one coordinate direction;

vacuum means associated with said moveable support surface for causing air to be drawn through said support surface from a vacuum source to cause sheet material supported by said support surface to be compressed and held in place against the support surface;

a first roller rotatably mounted to said carriage for movement with the carriage along said one coordinate direction;

a second roller rotatably mounted to said frame and associated with said frame second end, said second roller extending generally parallel to and in alignment with said first roller;

an elongate sheet of air impermeable material having opposite ends wound about said first and second rollers respectively with a portion of the air impermeable sheet material extending between said first and second rollers for sealing cut sheet material on the support surface;

means associated with each of said first and second rollers for automatically returning an amount of said air impermeable material previously dispensed from one of said first and second rollers to the other of said first and second rollers in response to the movement of the carriage along said one coordinate directions between said first and second ends of said frame; and wherein said means associated with each of said first and second rollers for automatically returning an amount of sheet material to the roller from which it was unwound includes an elongate elastic member extending axially of the roller internally thereof.

22. A method for sealing cuts made in a layup of sheet material in an automatic cutting machine comprising the steps of:

providing a moveable support surface having a vacuum hold down conveyor type advancement system capable of moving sheet material in a first coordinate direction;

providing a tool carriage moveable along said first coordinate direction between a first end of said frame and the second end of said frame;

providing a first roller means associated with said tool carriage and coupling it for movement with said tool carriage for movement between said first and second ends of said frame;

providing a second roller means disposed at said frame second end and rotatably mounting it to said frame;

providing an air impermeable sheet and winding the opposite ends thereof about each of said first and second roller means to allow the portion extending therebetween to spread over the sheet material supported on the support surface when said carriage is moved from said second end of said frame to said first end;

applying a preload to each of said first and second roller means in opposite directions and maintaining the sum of said preloads in at least one of said first and second roller means during cutting and advancement operations to automatically rewind a length of said air impermeable material onto the one of said first and second roller means from which it was dispensed to effect an equilibrium between each of the first and second rollers;

maintaining the initial preload in said second roller means and unwinding said first roller means against the torsional preload therein to dispense a length of said air impermeable material onto said supporting surface so as to add additional torsion load to said first roller means;

holding said first roller means in a non-rotating state once said carriage has travelled to said first end of said frame after completing a cutting operation and advancing both the support surface, the layup on it and the carriage to a carriage datum in unison;

allowing said preload in said second roller means to take up the air impermeable sheet material as the carriage, support surface, and layup are advanced toward said datum driving said first roller means upwardly away from the layup as said carriage approaches said datum to break the vacuum between said air impermeable overlay sheet and said vacuum table; and allowing said first roller means to exhibit a rewind force on the second roller means to cause the length of overlay material advanced off said frame second end to be wound back on the first roller means.

* * * * *